United States Patent [19]

Sato et al.

[11] Patent Number: 4,680,257

[45] Date of Patent: Jul. 14, 1987

[54] SILVER HALIDE PHOTOGRAPHIC LIGHT-SENSITIVE MATERIAL

[75] Inventors: Hideaki Sato; Morio Yagihara, both of Kanagawa, Japan

[73] Assignee: Fuji Photo Film Co., Ltd., Kanagawa, Japan

[21] Appl. No.: 775,959

[22] Filed: Sep. 13, 1985

Related U.S. Application Data

[63] Continuation-in-part of Ser. No. 586,922, Mar. 7, 1984, abandoned.

[30] Foreign Application Priority Data

Mar. 7, 1983 [JP] Japan ..... 58-36907

[51] Int. Cl.[4] ..... G03C 1/30; G03C 1/06

[52] U.S. Cl. ..... 430/614; 430/622

[58] Field of Search ..... 430/614, 622, 623, 626

[56] References Cited

U.S. PATENT DOCUMENTS

| | | | |
|---|---|---|---|
| 3,888,681 | 6/1975 | Horie et al. | 430/626 |
| 3,905,821 | 9/1975 | Ohtani et al. | 430/600 |
| 4,054,458 | 10/1977 | Ohtani et al. | 430/600 |
| 4,418,140 | 11/1983 | Mitune et al. | 430/622 |

*Primary Examiner*—Won H. Louie

*Attorney, Agent, or Firm*—Sughrue, Mion, Zinn, Macpeak & Seas

[57] ABSTRACT

A silver halide photographic light-sensitive material is disclosed. The material is composed of a support base having a silver halide emulsion layer thereon which contains a hardener having an active vinyl group. The material also includes a compound represented by the general formula (I):

(I)

wherein $R_1$, $R_2$ and $R_3$ independently represent a hydroxy group, a hydroxylamino group, an amino group, an alkylamino group, a substituted alkylamino group, an arylamino group, an alkoxy group, a phenoxy group, an alkyl group, an aryl group or a halogen atom. The photographic material gives improved results with respect to preventing latensification.

14 Claims, No Drawings

SILVER HALIDE PHOTOGRAPHIC LIGHT-SENSITIVE MATERIAL

This is a continuation-in-part, of application Ser. No. 586,922, filed Mar. 7, 1984, abandoned.

FIELD OF THE INVENTION

This invention relates to a silver halide photographic light-sensitive material and, more particularly, to a silver halide photographic light-sensitive material having improved storage properties with respect to its latent image.

BACKGROUND OF THE INVENTION

It is well known that image formation with silver halide photography requires two processes, i.e., a process of exposure for producing a latent image and a process of development for converting the produced latent image into a silver image or dye image (see, for example, T. H. James, *The Theory of the Photographic Process*).

Latent image formation by imagewise exposure chemically causes an extremely slight change in the silver halide crystals and, therefore, the latent image itself is essentially unstable. Accordingly, the latent image is liable to be attenuated with the lapse of time after exposure till development or is susceptible to intensification.

In the field of photography, this attenuation of the latent image is called latent image fading, and the latter phenomenon is called latensification.

The behavior of a latent image is generally dependent upon the conditions under which exposed light-sensitive materials are stored. For example, considerable latent image fading or latensification results under storage at elevated temperatures, whereas less latent image fading or latensification results under storage at low temperatures.

The simplest technique for avoiding disadvantages of latent image fading or latensification is to conduct development processing immediately after image-wise exposure, and the second simplest technique is to store exposed light-sensitive materials at low temperatures under cooling during the period between exposure and development processing.

These techniques are simplest and easiest from the chemical point of view, but they are not always convenient for the photographer. In actual conditions or manners under or in which light-sensitive materials are used, they are in some cases several months between exposure and development processing. With light-sensitive materials, particularly multilayered color photographic light-sensitive materials, in which the latent image fading or latensification differs in different layers, there results poor color balance, leading to deterioration of color reproduction.

In recent years, hardeners have come into use which have active vinyl groups and which exhibit a rapid hardening effect and cause less change in the hardening effect after a long period of time, called "post hardening". Examples of such compounds are described in U.S. Pat. Nos. 3,689,274, 3,868,257, 4,028,320, 4,088,495, 4,137,082 and 4,173,481, British Pat. No. 1,397,905, Japanese Patent Application (OPI) Nos. 66960/78 and 30022/79 (the term "OPI" as used herein refers to a "published unexamined Japanese patent application"), and Japanese Patent Publication No. 46495/77.

However, the use of such active vinyl group-containing hardener concurrently may cause latensification.

Techniques for preventing latensification include those in U.S. Pat. No. 3,881,933 which describes the use of hardeners which release an acid in an emulsion film in order to reduce the pH, Japanese Patent Application (OPI) No. 6725/73 which describes adding a rhodium compound and an iridium compound upon emulsification of silver halide, Japanese Patent Publication No. 23250/82 which describes adding a mercapto hetero ring compound to a silver halide emulsion prepared by using a rhodium compound, and Japanese Patent Application (OPI) No. 127714/78 which describes adding a hydroxyazaindolidine compound and a nitrogen-containing hetero ring compound having a mercapto group to a silver halide emulsion prepared by using a rhodium compound. However, these techniques require specially prepared silver halide emulsions or require silver halide emulsions spectrally sensitized with particular sensitizing dyes, or provide only insufficient effects, thus none of these techniques being fully satisfactory.

SUMMARY OF THE INVENTION

An object of the present invention is to provide a technique for preventing latensification of a silver halide photographic emulsion containing an active vinyl group-containing hardener.

Another object of the present invention is to provide a technique for preventing latensification of a silver halide photographic emulsion containing an active vinyl group-containing hardener wherein the photographic material exhibits excellent specific sensitivity, which is an indication of latent image fading, coupled with excellent hardening (i.e., fast curing).

As a result of extensive investigations, the inventors have found that the objects of the present invention can be attained by adding to a silver halide photographic light-sensitive material a triazine derivative represented by the following general formula (I):

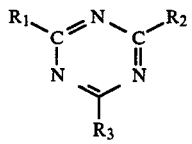

(I)

wherein $R_1$, $R_2$, and $R_3$ independently represent a hydroxy group, a hydroxylamino group, an amino group, an alkylamino group having 1 to 30 carbon atoms, preferably 1 to 20 carbon atoms and more preferably 1 to 10 carbon atoms, a substituted alkylamino group having 1 to 30 carbon atoms, preferably 1 to 20 carbon atoms and more preferably 1 to 10 carbon atoms, an arylamino group having 6 to 30 carbon atoms, preferably 6 to 20 carbon atoms and more preferably 6 to 10 carbon atoms, an alkoxy group having 1 to 30 carbon atoms, preferably 1 to 20 carbon atoms and more preferably 1 to 10 carbon atoms, a phenoxy group, an alkyl group having 1 to 30 carbon atoms, preferably 1 to 20 carbon atoms and more preferably 1 to 10 carbon atoms, an aryl group having 6 to 30 carbon atoms, preferably 6 to 20 carbon atoms and more preferably 6 to 10 carbon atoms or a halogen atom, with at least one of $R_1$, $R_2$, and $R_3$ preferably being a hydroxylamino group. More preferably, the sum of carbon atoms in the substituents represented by $R_1$, $R_2$, and $R_3$ is 4 to 30, particularly 8 to 20.

DETAILED DESCRIPTION OF THE INVENTION

Examples of the substitutensts for the substituted alkylamino group represented by $R_1$, $R_2$ or $R_3$ include a hydroxy group, an alkoxy group, a halogen atom, an aryl group, a carboxy group, a sulfo group and a nitro group.

Specific examples of compounds of the general formula (I) to be used in the present invention are illustrated below. The following compounds may be used alone or two or more of the compounds may be used in combination. The compounds of the general formula (I) are not limited to the following specific examples.

(1)

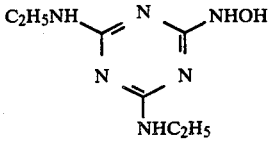

m.p. 194–196° C.

(2)

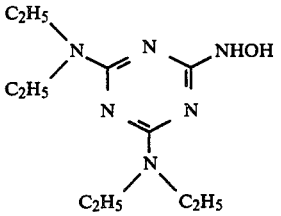

m.p. 146–147° C.

(3)

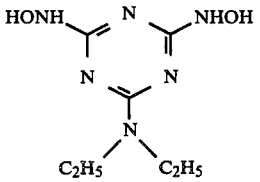

m.p. 190° C.

(4)

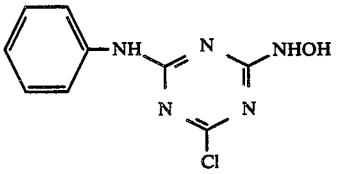

m.p. 105–111° C.

(5)

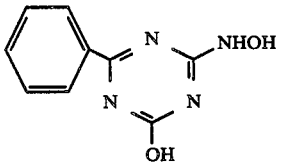

m.p. 250° C.

(6)

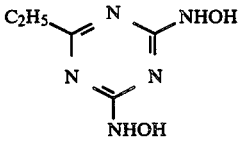

m.p. 208–210° C.

-continued (7)

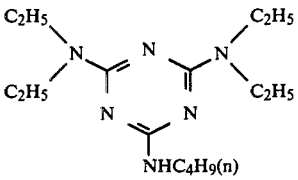

b.p. 183–186° C./45 mm Hg (8)

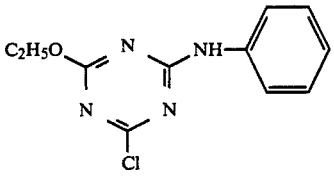

m.p. 110–114° C.

(9)

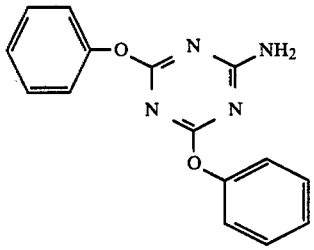

m.p. 181–182° C.

(10)

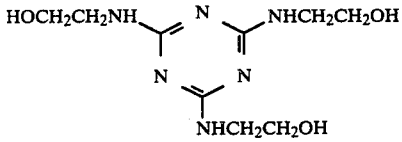

m.p. 97–98° C.

(11)

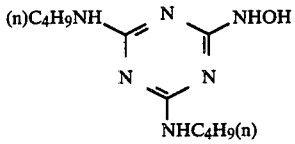

m.p. 140–142° C.

(12)

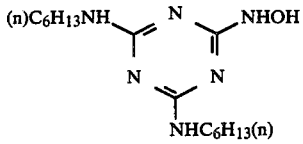

m.p. 134–135° C.

(13)

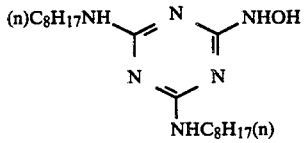

m.p. 115–117° C.

(14)

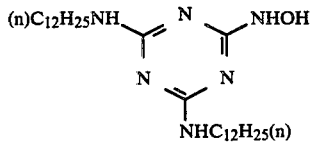

m.p. 121–123° C.

-continued (15)

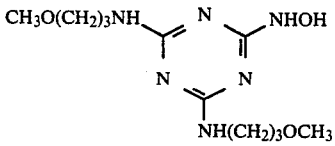

oily material (16)

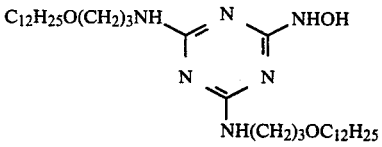

m.p. 83–85° C.

(17)

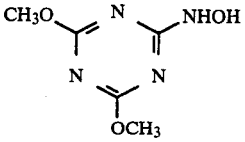

m.p. 172–173° C.

(18)

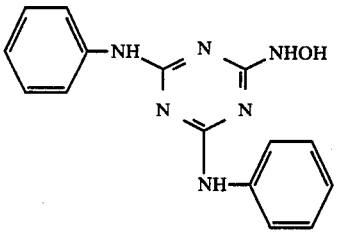

m.p. 175–176° C.

(19)

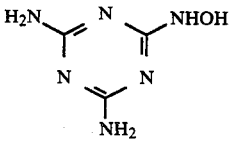

m.p. >300° C.

(20)

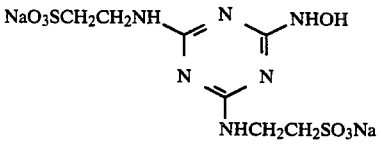

-continued m.p. >250° C.

(21)

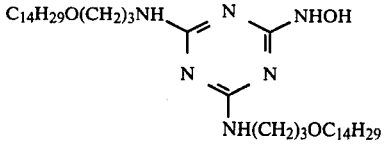

m.p. 81–83° C.

These compounds can be synthesized by the reaction between chloro-s-triazine or its derivative and a corresponding amine, phenol or alcohol according to the synthesizing processes described in, for example, *J. Am. Chem. Soc.*, 73, 2981, *J. Org. Chem.*, 27, 4054 or U.S. Pat. Nos. 3,905,821 and 4,054,458.

The amount of the compound of the general formula (I) to be added is not particularly limited, but an amount of 0.00001 to 0.10 mol, particularly 0.0005 to 0.01 mol, per mol of silver is preferable.

The position to which the compound is added is not particularly limited, but a silver halide emulsion layer or its adjacent layer is preferable.

The compound may be added by dispersing it in a high-boiling organic solvent in the same manner as with color couplers or by dissolving it in an alcohol or the like.

Any active vinyl group-containing hardener can be used. For example, those described in U.S. Pat. Nos. 3,040,720, 3,490,911, 3,539,644, 3,635,718, 3,689,274 3,868,257, 4,028,320, 4,088,495, 4,137,082, 4,142,897 and 4,173,481, British Pat. No. 1,397,905, West German Pat. No. 872,153, Japanese Patent Publication Nos. 8736/72, 35807/75 and 46495/77, and Japanese Patent Application (OPI) Nos. 66960/78 and 30022/79 can be used.

Preferable hardeners are those represented by the following general formula (II):

$$(CH_2{=}CH{-}SO_2{-}CH_2)_2{-}A \qquad (II)$$

wherein A represents a divalent group or may be absent.

Examples of preferred hardeners which may be used with the present invention are illustrated below.

Examples of the compounds:

V-1 $CH_2{=}CHSO_2CH_2\underset{\underset{OH}{|}}{C}HCH_2SO_2CH{=}CH_2$

V-2 $CH_2{=}CHSO_2CH_2\underset{\underset{OH}{|}}{C}H\underset{\underset{OH}{|}}{C}HCH_2SO_2CH{=}CH_2$ V-3 $CH_2{=}CH.SO_2CH_2\underset{\underset{OH}{|}}{C}H.CH_2\underset{\underset{OH}{|}}{C}HCH_2SO_2CH{=}CH_2$ V-4 $CH_2{=}CH{-}SO_2.CH_2\underset{\underset{OH}{|}}{C}H\underset{\underset{OH}{|}}{C}H\underset{\underset{OH}{|}}{C}HCH_2SO_2CH{=}CH_2$

V-5 $(CH_2{=}CH{-}SO_2CH_2CONH)_2$

V-6 $(CH_2{=}CH.SO_2CH_2CONH)_2CH_2$

V-7 $(CH_2{=}CHSO_2CH_2CONHCH_2)_2$

V-8 $(CH_2{=}CHSO_2CH_2CONHCH_2)_2CH_2$

V-9

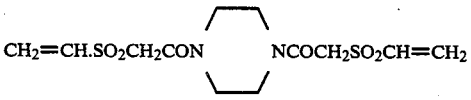

V-10

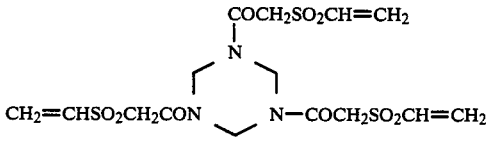

-continued

Examples of the compounds:

V-11

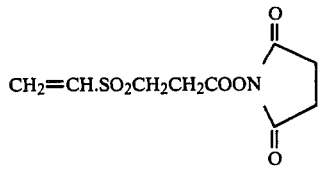

V-12

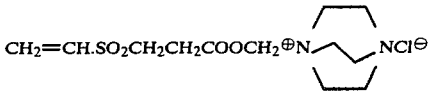

$CH_2{=}CHSO_2CH_2SO_2CH{=}CH_2$ V-13 $CH_2{=}CH.SO_2CH_2CH_2SO_2CH{=}CH_2$ V-14

$CH_2{=}CH.SO_2CH_2CH_2CH_2SO_2CH{=}CH_2$ V-15

V-16

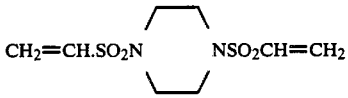

$C_2H_5C(CH_2SO_2CH{=}CH_2)_3$ V-17 $CH_2{=}CHSO_2CH_2CH(SO_2CH{=}CH_2)CH_2SO_2CH{=}CH_2$ V-18

V-19

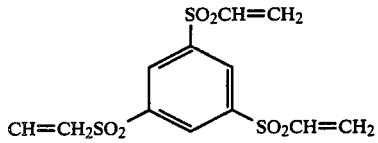

V-20

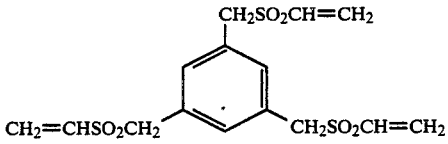

$(CH_2{=}CHSO_2CH_2)_4C$ V-21 $(CH_2{=}CHSO_2CH_2)_3CCH_2SO_2CH_2CH_2NHCH_2CH_2SO_3Na$ V-22

V-23

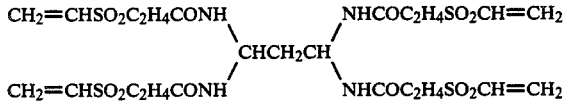

V-24

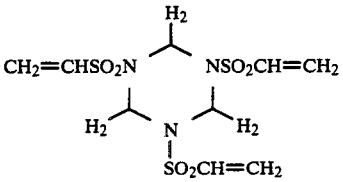

V-25

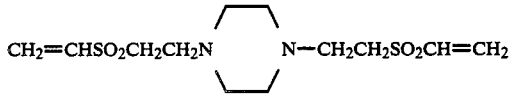

V-26

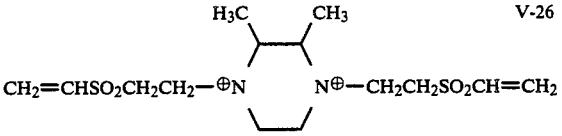

$2ClO_4$

V-27

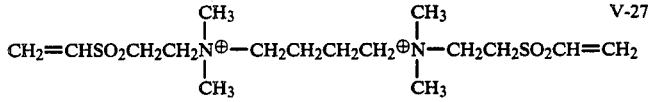

V-28

$CH_2{=}CHSO_2CH_2CH_2SO_2CH_2CH_2SO_2CH{=}CH_2$

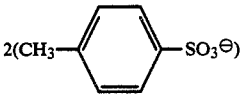

$CH_2{=}CHSO_2CH_2CH_2OCH_2CH_2NHCONHCH_2CH_2OCH_2CH_2SO_2CH{=}CH_2$ V-29

$CH_2{=}CHSO_2CH_2CH_2OCH_2CH_2OCH_2CH_2SO_2CH{=}CH_2$ V-30 $CH_2{=}CHSO_2CH_2OCH_2SO_2CH{=}CH_2$ V-31

V-32

$CH_2{=}CHSO_2CH_2CH_2OCH_2CH_2SO_2CH{=}CH_2$

V-33

$CH_2{=}CHSO_2CH_2CH_2CH_2CH_2OCH_2CH_2CH_2CH_2SO_2CH{=}CH_2$ $(CH_2{=}CH.SO_2CH_2CH_2CONH)_2CH_2$ V-34 $(CH_2{=}CH{-}SO_2CH_2CH_2CONH.CH_2)_2$ V-35

V-36

$(CH_2{=}CH{-}SO_2CH_2CH_2CONHCH_2)_2CH_2$

V-37

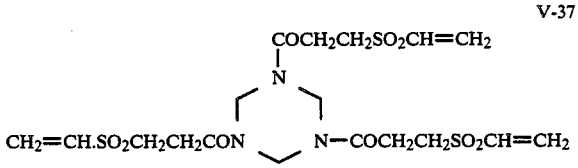

-continued

Examples of the compounds:

$CH_2{=}CHSO_2CH{=}CH_2$ V-38

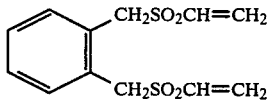

V-39

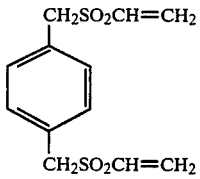

V-40

Of the above hardeners, V-1~V-8, V-13~V-15, V-17 and V-28~V-36 are particularly preferred.

The amount of the gelatin hardener to be used in the present invention can be arbitrarily selected depending upon the purpose and, usually, it ranges from 0.01 to 20 wt%, preferably 0.1 to 10 wt%, based on the weight of the dry gelatin.

The photographic emulsion to be used in the present invention can be prepared by the processes described in P. Glafkides, *Chimie et Physique Photographique* (published by Paul Montel, 1967), G. F. Duffin, *Photographic Emulsion Chemistry* (The Focal Press, 1966), V. L. Zelikman et al., *Making and Coating Photographic Emulsion* (The Focal Press, 1964), etc. That is, any of an acid process, a neutral process and an ammoniacal process can be used. The soluble silver salt may be reacted with a soluble halide salt by side-mixing, simultaneous mixing, or a combination thereof.

A process of forming grains in the presence of excess silver ions (called a reverse mixing process) can be employed as well. One type of simultaneous mixing process which may be used is the controlled double jet process wherein the pAg in a liquid phase in which the silver halide is formed is kept constant. This process provides a silver halide emulsion containing silver halide grains having an approximately uniform particle size.

Two or more silver halide emulsions which have been separately prepared may be mixed for use.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be allowed to coexist.

Soluble salts may be removed from the emulsion after forming precipitates or physical ripening by a noodle washing method of gelling gelatin or a flocculation method utilizing an inorganic slat, an anionic surfactant, an anionic polymer (e.g., polystyrenesulfonic acid) or a gelatin derivative (e.g., acylated gelatin, carbamoylated gelatin, etc.).

The silver halide emulsion is usually chemically sensitized. Chemical sensitization is conducted, for example, according to the processes described in *Die Grundlagen der Photographischen Prozesse mit Silberhalogeniden* (Akademische Verlagsgesellschaft, 1968) (compiled by H. Frieser), pp. 675–734.

The binder or protective colloid for the photographic emulsion layers is preferably a gelatin. However, other hydrophilic colloids can be used as well. For example, proteins such as gelatin derivatives, graft, polymers between gelatin and other high polymer, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic substances such as homopolymers or copolymers (e.g., polyvinyl alcohol, partially acetalized polyvinyl alcohol, poly-N-vinylpyrrolidone, polyacrylic acid, polymethacrylic acid, polyacrylamide, polyvinyl imidazole, polyvinyl pyrazole, etc.) can be used.

Useful gelatins include acid-processed gelatin or enzyme-processed gelatin as described in *Bull. Soc. Sci. Phot. Japan,* No. 16, p. 30 (1966) as well as limeprocessed gelatin, and a gelatin hydrolysate or an enzyme-decomposed product. Useful gelatin derivatives include those obtained by reacting gelatin with, for example, acid halides, acid anhydrides, isocyanates, bromoacetic acid, alkanesultones, vinylsulfonamides, maleinimide compounds, polyalkylene oxides, epoxy compounds, or the like. Specific examples thereof are described in U.S. Pat. Nos. 2,614,928, 3,132,945, 3,186,846, 3,312,553, British Pat. Nos. 861,414, 1,033,189 and 1,005,784, Japanese Patent Publication No. 26845/67, etc.

Useful gelatin graft polymers include products prepared by grafting to gelatin a homo- or copolymer of vinyl monomer such as acrylic acid, methacrylic acid, ester or amide thereof, acrylonitrile, styrene, or the like. In particular, graft polymers between gelatin and a polymer having some compatibility with gelatin such as a polymer of acrylic acid, methacrylic acid, acrylamide, methacrylamide, hydroxyalkyl methacrylate or the like are preferable. Examples of these are described in U.S. Pat. Nos. 2,763,625, 2,831,767, 2,956,884, etc.

Typical synthetic high molecular substances are those described in, for example, West German Patent Application (OLS) No. 2,312,708, U.S. Pat. Nos. 3,620,751 and 3,879,205, and Japanese Patent Publication No. 7561/68.

Various compounds may be added to the photographic emulsion to be used in the present invention for the purpose of preventing fogging of light-sensitive materials during production steps, storage or photographic processing or for stabilizing photographic properties. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); hetero ring-containing mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines); hetero ring-containing mercapto compounds described above having a water-soluble group such as a carboxy group or a sulfo group; thioketo compounds (e.g., oxazolinethione); azaindenes (e.g., tetraazaindenes (particularly 4-hydroxysubstituted (1,3,3*a*,7)tetraazaindenes), etc.); benzenethiosulfonic acids; benzenesulfinic acids; etc., can be added.

Specific examples of using such additives are disclosed in U.S. Pat. Nos. 3,954,474, 3,982,947 and 4,021,248 or Japanese Patent Publication No. 28660/77.

The photographic emulsion to be used in the present invention may be spectrally sensitized with methine dyes or the like.

Useful sensitizing dyes are those described in, for example, German Pat. No. 929,080, U.S. Pat. Nos. 2,493,748, 2,503,776, 2,519,001, 2,912,329, 3,656,959, 3,672,897, 4,025,349, British Pat. No. 1,242,588, and Japanese Patent Publication No. 14030/69.

These sensitizing dyes may be used alone or in combination. Combinations of sensitizing dyes are often employed particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,66,480, 3,672,898, 3,679,428, 3,814,609, 4,026,707 and 4,152,163 and British Pat. Nos. 1,344,281 and 1,547,045, and Japanese Patent Publication Nos. 4936/68 and 12375/78.

The photographic emulsion of the present invention contains color-forming couplers capable of forming color by oxidative coupling with an aromatic primary amine developing agent (for example, a phenylenediamine derivative or an aminophenol derivative) in color development processing. For example, magenta couplers include 5-pyrazolone couplers, pyrazolobenzimidazole couplers, cyanoacetylcoumarone couplers, openchain acylacetonitrile couplers, etc., yellow couplers include acylacetamide couplers (e.g., benzoylacetanilides, pivaloylacetanilides, etc.), etc., and cyan couplers include naphthol couplers, phenol couplers, etc. Of these couplers, non-diffusible couplers having a hydrophobic group called ballast group are desirable. The couplers may be of either 4-equivalent type or 2-equivalent type. Colored couplers having color-correcting effect or couplers capable of releasing a development inhibitor upon development (called DIR couplers) may also be used.

In addition to DIR couplers, DIR coupling compounds capable of forming a colorless coupling reaction product and releasing a development inhibitor may also be incorporated.

Introduction of the couplers into silver halide emulsion layers is conducted in a known manner, for example, according to the method described in U.S. Pat. No. 2,322,027. For example, the couplers are dissolved in an alkyl phthalate (e.g., dibutyl phthalate, dioctyl phthalate, etc.), phosphoric esters (e.g., diphenyl phosphate, triphenyl phosphate, tricresyl phosphate, dioctylbutyl phosphate, etc.), citric esters (e.g., tributyl acetylcitrate), benzoic esters (e.g., octyl benzoate), alkylamides (e.g., diethyllaurylamide), fatty acid esters (e.g., dibutoxyethyl succinate, dioctyl azelate, etc.), trimesic acid esters (e.g., tributyl trimesate), etc., or organic solvents having a boiling point of about 30° to about 150° C. such as lower alkyl acetates (e.g., ethyl acetate, butyl acetate, etc.), ethyl propionate, sec-butyl alcohol, methyl isobutyl ketone, β-ethoxyethyl acetate, methyl cellosolve acetate, etc., and dispersed in a hydrophilic colloid. The above-described high-boiling solvents and the low-boiling organic solvents may be used in combination. In addition, a dispersing method using a polymer described in Japanese Patent Publication No. 39853/76 and Japanese Patent Application (OPI) No. 59943/76 can be used.

Couplers with an acid group such as carboxylic acid or a sulfonic acid are introduced into a hydrophilic colloid as an alkaline aqueous solution.

The present invention will now be described in more detail by the following non-limiting examples.

EXAMPLE 1

On a polyethylene terephthalate film support were provided layers of the following formulations to prepare multilayered color light-sensitive material, Sample 101.

Sample 101

1st Layer: Antihalation Layer (AHL)

A gelatin layer containing black colloidal silver.

2nd Layer: Interlayer (ML)

A gelatin layer containing an emulsion dispersion 2,5-di-t-octylhydroquinone.

3rd Layer: First Red-Sensitive Emulsion Layer ($RL_1$)

Silver bromoiodide emulsion (silver iodide: 4 mol%; mean grain size: 0.35μ; polydisperse emulsion) coated silver amount: 0.25 g/m$^2$ Silver bromoiodide emulsion (silver iodide: 6 mol%; mean grain size: 0.65μ; monodisperse emulsion) coated silver amount: 1.2 g/m$^2$

| | |
|---|---|
| Sensitizing Dye I | $6 \times 10^{-5}$ mol/mol Ag |
| Sensitizing Dye II | $1.5 \times 10^{-5}$ mol/mol Ag |
| Coupler C-1 | 0.09 mol/mol Ag |
| Coupler Ex-1 | 0.003 mol/mol Ag |
| Coupler D-1 | 0.005 mol/mol Ag |

4th Layer: Second Red-Sensitive Emulsion Layer ($RL_2$)

Silver bromoiodide emulsion (silver iodide: 6 mol%; mean grain size: 0.70μ; monodisperse emulsion) coated in a silver amount of 2.4 g/m$^2$

| | |
|---|---|
| Sensitizing Dye I | $4 \times 10^{-5}$ mol/mol Ag |
| Sensitizing Dye II | $1.2 \times 10^{-5}$ mol/mol Ag |
| Coupler C-1 | 0.012 mol/mol Ag |
| Coupler Ex-1 | 0.0008 mol/mol Ag |

5th Layer: Third Red-Sensitive Emulsion Layer ($RL_3$)

Silver bromoiodide emulsion (silver iodide: 10 mol%; mean grain size: 1.4μ; polydisperse emulsion) coated silver amount: 1.2 g/m$^2$

| | |
|---|---|
| Sensitizing Dye I | $3 \times 10^{-5}$ mol/mol Ag |
| Sensitizing Dye II | $1.2 \times 10^{-5}$ mol/mol Ag |
| Coupler C-2 | 0.019 mol/mol Ag |
| Coupler Ex-1 | 0.0015 mol/mol Ag |

6th Layer: Interlayer (ML)

Same as the 2nd layer.

7th Layer: First Green-Sensitive Emulsion Lyaer ($GL_1$)

Silver bromoiodide emulsion (silver iodide: 4 mol%; mean grain size: 0.35μ; polydisperse emulsion) coated silver amount: 0.3 g/m$^2$ Silver bromoiodide emulsion (silver iodide: 6 mol%; mean grain size: 0.65μ; monodisperse emulsion) coated silver amount: 0.7 g/m$^2$

| | |
|---|---|
| Sensitizing Dye III | $3 \times 10^{-5}$ mol/mol Ag |
| Sensitizing Dye IV | $1 \times 10^{-5}$ mol/mol Ag |
| Coupler M-2 | 50 g/mol Ag |

-continued

| | |
|---|---|
| Coupler Ex-2 | 0.008 mol/mol Ag |
| Coupler Ex-3 | 0.011 mol/mol Ag |

8th Layer: Second Green-Sensitive Emulsion Layer ($GL_2$)

Silver bromoiodide emulsion (silver iodide: 6 mol%; mean grain size: 0.70μ; monodisperse emulsion) coated silver amount: 0.5 g/m$^2$

| | |
|---|---|
| Sensitizing Dye III | $2.5 \times 10^{-5}$ mol/mol Ag |
| Sensitizing Dye IV | $0.9 \times 10^{-5}$ mol/mol Ag |
| Coupler M-1 | 0.012 mol/mol Ag |
| Coupler Ex-2 | 0.001 mol/mol Ag |

9th Layer: Third Green-Sensitive Emulsion Layer ($GL_3$)

Silver bromoiodide emulsion (silver iodide: 10 mol%; mean grain size: 1.0μ; polydisperse emulsion) coated silver amount: 1.2 g/m$^2$

| | |
|---|---|
| Sensitizing Dye III | $2.0 \times 10^{-5}$ mol/mol Ag |
| Sensitizing Dye IV | $0.7 \times 10^{-5}$ mol/mol Ag |
| Coupler M-1 | 0.015 mol/mol Ag |
| Coupler Ex-2 | 0.002 mol/mol Ag |

10th Layer: Yellow Filter Layer (YFL)

A gelatin layer containing in gelatin aqueous solution an emulsion dispersion of yellow colloidal silver and 2,5-di-t-octylhydroquinone.

11th Layer: First Blue-Sensitive Emulsion Layer ($BL_1$)

Silver bromoiodide emulsion (silver iodide: 6 mol%; mean grain size: 0.3μ) coated silver amount: 1.5 g/m$^2$

| | |
|---|---|
| Coupler Y-1 | 0.25 mol/mol Ag |
| Coupler Ex-3 | 0.015 mol/mol Ag |

12th Layer: Second Blue-Sensitive Emulsion Layer ($BL_2$)

Silver bromoiodide emulsion (silver iodide: 6 mol%; mean grain size: 0.7μ) coated Ag amount: 1.1 g/m$^2$

| | |
|---|---|
| Coupler Y-1 | 0.06 mol/mol Ag |

13th Layer: First Protective Layer ($PL_1$)

Silver bromoiodide emulsion (silver iodide: 1 mol%; mean grain size: 0.07μ) coated Ag amount: 0.5 g/m$^2$ gelatin layer containing an emulsion dispersion of an ultraviolet ray absorbent, UV-1.

14th Layer: Second Protective Layer ($PL_2$)

A gelatin layer containing polymethyl methacrylate particles (diameter: about 1.5μ) was coated.

To each of the above-described layers was added gelatin hardeners, V-7 and V-8, and a surfactant in addition to the above-described compositions. The thus prepared sample was called Sample 101.

Compounds Used for Preparing Samples

| | |
|---|---|
| Sensitizing Dye I* | Anhydro-5,5'-dichloro-3,3'-di(γ-sulfopropyl)-9-ethyl-thiacarbocyanine hydroxide pyridinium salt |
| Sensitizing Dye II: | Anhydro-9-ethyl-3,3'-di(γ-sulfopropyl)-4,5,4',5'-dibenzothiacarbocyanine hydroxide triethylamine salt |
| Sensitizing Dye III: | Anhydro-9-ethyl-5,5'-dichloro-3,3'-di(γ-sulfopropyl)oxacarbocyanine sodium salt |
| Sensitizing Dye IV: | Anhydro-5,6,5',6'-tetrachloro-1,1'-dietlyl-3,3'-di{β-[β-(γ-sulfopropoxy)ethoxy]-ethylimidazolo}carbocyanine hydroxide sodium salt |

C-1

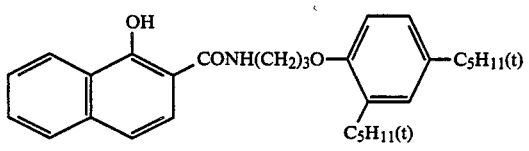

C-2

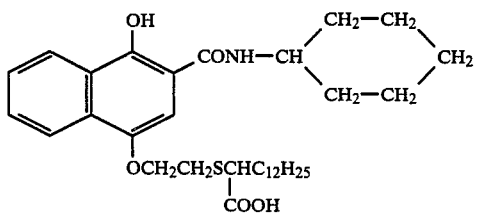

-continued
Compounds Used for Preparing Samples
Ex-1
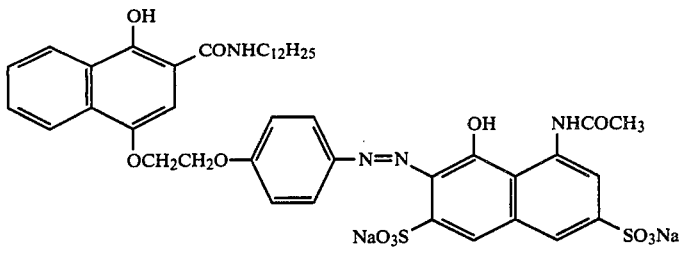
Ex-2
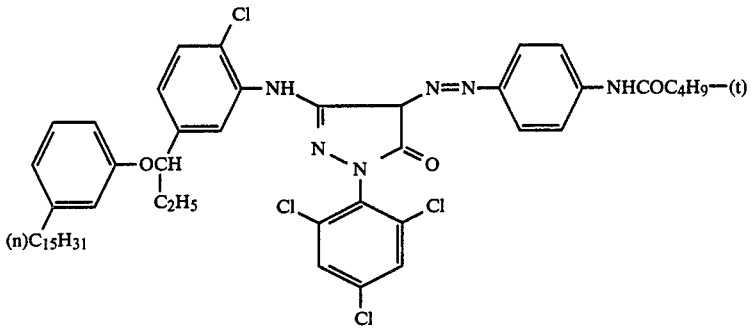
Ex-3
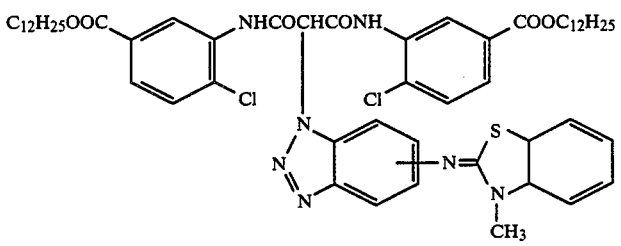
D-1
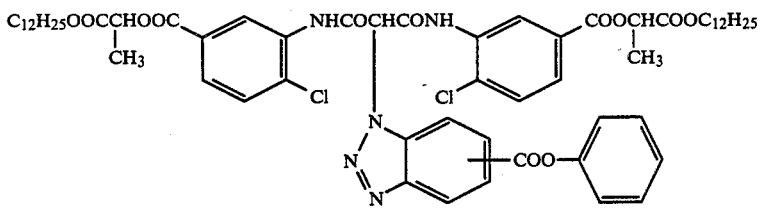
M-1
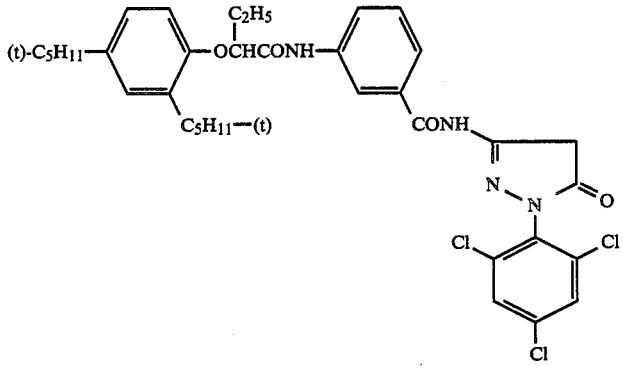

-continued

Compounds Used for Preparing Samples

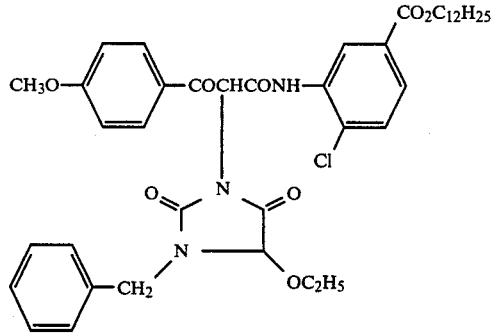

Y-1

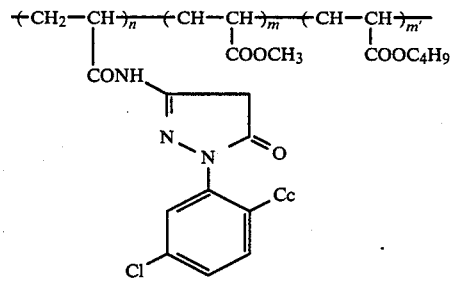

M-2 n/(m + n) = 1, m/m' = 1 (by weight)

Samples 102 to 105

Samples 102 to 105 were prepared in the same manner as with Sample 101 except for adding, to $RL_3$ of Sample 101, 0.00207 mol/mol Ag of Compound (1), 0.00207 mol/mol Ag of Compound (12), 0.00103 mol/mol Ag of Compound (16) or 0.00103 mol/mol Ag of Compound (21).

EXAMPLE 2

Samples 201 and 202 were prepared in the same manner as with Sample 101 except for adding, to $RL_3$ of Sample 101, a dispersion of Couplers C-2 and C-1 and 0.00207 mol/mol Ag of Compound (16) or (21) prepared by dissolving them in tricresyl phosphate and dispersing the resulting solution in gelatin.

EXAMPLE 3

Samples 301, 302 and 303 were prepared in the same manner as with Sample 101 except for adding, to $GL_1$ of Sample 101, a dispersion of Coupler M-1, Coupler Ex-2, and 0.00112 mol, 0.00224 mol or 0.00336 mol/mol Ag of Compound (16) prepared by dissolving them in tricresyl phosphate and dispersing the resulting solution in gelatin.

The thus-prepared samples were wedge-exposed using white light, stored in a freezer or under the conditions of 40° C. and 80% RH or 50° C., then subjected to the following development processing.

| | |
|---|---|
| 1. Color Development | 3 min 15 sec |
| 2. Bleaching | 6 min 30 sec |
| 3. Washing with water | 3 min 15 sec |
| 4. Fixing | 6 min 30 sec |
| 5. Washing with water | 3 min 15 sec |
| 6. Stabilizing | 3 min 15 sec |

Compositions of the processing solutions used in the respective steps are as follows.

| | |
|---|---|
| Color Developing Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution | |
| Ammonium Bromide | 160.0 g |
| Aqueous Ammonia (28%) | 25.0 ml |
| Sodium Iron Ethylenediaminetetra-acetate | 130 g |
| Glacial Acetic Acid | 14 ml |
| Water to make | 1 liter |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Bisulfite | 4.6 g |
| Water to make | 1 liter |
| Stabilizing Solution | |
| Formalin | 8.0 ml |
| Water to make | 1 liter |

TABLE 1

| Sample No. | Compound No. | Specific Sensitivity* |
|---|---|---|
| 101 | None | 148 |
| 102 | (1) | 120 |
| 103 | (12) | 120 |
| 104 | (16) | 120 |
| 105 | (21) | 132 |

*Specific sensitivity obtained by comparing sensitivity at a cyan density of 0.35 of the sample stored for 7 days under the conditions of 40° C. and 80% RH with that of the sample stored in a freezer (taking the sensitivity of the freezer-stored sample as 100)

TABLE 2

| Sample No. | Compound No. | Specific Sensitivity* |
|---|---|---|
| 101 | None | 148 |
| 201 | (16) | 123 |
| 202 | (21) | 112 |

TABLE 3

| Sample No. | Compound No. | Specific Sensitivity** |
|---|---|---|
| 101 | None | 112 |
| 301 | (16) | 110 |
| 302 | (16) | 105 |
| 303 | (16) | 98 |

**Specific sensitivity obtained by comparing sensitivity at a magenta density of 1.3 of the sample stored for 3 days at 50° C. with that of the sample stored in a freezer (taking the sensitivity of the freezer-stored sample as 100)

Thus, it is seen that the compounds of the present invention show remarkable effects in preventing latensification.

EXAMPLE 4

Samples 101, 102 and 201 through 204 were prepared in the same manner as Example 1 except that the gelatin hardener and the latensifying agent shown in Table 3 below were used instead of those used in Example 1.

The specific sensitivity of these samples were measured in the same manner as in Example 1.

On the other hand, the samples were stored at a temperature of 25° C. and a relative humidity of 60%, and a part of each sample was taken out after 1, 7, 14 or 21 days and tested to determine the degree of swelling (Q) in water at 25° C. defined by the following equation.

$$Q = \frac{\text{Increase in Thickness After Swelling}}{\text{Dry Thickness}}$$

Furthermore, the degree of swelling (Q) of samples which were cured at a temperature of 50° C. and a relative humidity of 80% for 2 days were also determined.

The results obtained are shown in Table 3 below.

TABLE 3

| Sample | | Latensifying Agent | Gelatin Hardner | Specific Sensitivity | Q (day) 1 | 7 | 14 | 21 | 50° C. 80% RH 2 |
|---|---|---|---|---|---|---|---|---|---|
| 101 | Blank | — | V-7 and V-8 (1:1) (5 mmol/100 g gelatin) | 148 | 4.9 | 3.3 | 3.1 | 3.1 | 3.0 |
| 102 | Invention | Compound (1) (0.00207 mol/mol AgX) | V-7 and V-8 (1:1) (5 mmol/100 g gelatin) | 120 | 5.0 | 3.4 | 3.1 | 3.2 | 3.1 |
| 201 | Comparison | — | 2-oxy-4,6-dichloro-s-triazine (5 mmol/100 g gelatin) | 120 | 6.2 | 5.0 | 4.4 | 3.9 | 3.5 |
| 202 | " | Compound (1) (0.00207 mol/mol AgX) | 2-oxy-4,6-dichloro-s-triazine (5 mmol/100 g gelatin) | 80 | 6.1 | 5.1 | 4.3 | 3.9 | 3.5 |
| 203 | " | Hexahydro-1,3,5-triacryl-s-triazine (0.002 mol/mol AgX) | 2-oxy-4,6-dichloro-s-triazine (5 mmol/100 g gelatin) | 120 | 5.9 | 4.8 | 4.2 | 3.8 | 3.4 |
| 204 | " | 2-Oxy-4,6-dichloro-s-triazine (0.002 mol/mol AgX) | V-7 and V-8 (1:1) (5 mmol/100 g gelatin) | 135 | 5.0 | 3.4 | 3.2 | 3.2 | 3.1 |

From Table 3 above, it can be seen that only Sample 102 (present invention) exhibited excellent specific sensitivity, which is an indication of latent image fading, and excellent curing speed simultaneously. Sample 202 in which 2-oxy-4,6-dichloro-s-triazine was used in place of Compounds V-7 and V-8 suffered desensitization due to presence of Compound 1 and in addition curing of the gelatin layer was still proceeding after 21 days. Sample 203 in which the compound described in Example 5 of Horie et al U.S. Pat. No. 3,888,681 was used in the combination exhibited a specific sensitivity of same level as the sample of the present invention but had a defect that curing reaction did not terminate in a short period of time. Sample 204 in which 2-oxy-4,6-dichloro-s-triazine was used in place of Compound 1 exhibited poor specific sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support base having thereon:

a silver halide emulsion layer containing a hardener having an active vinyl group represented by the structural formula (II):

$$(CH_2{=}CH{-}SO_2{-}CH_2)_2{-}A \qquad \text{(II)}$$

wherein A represents a divalent group which is optionally present; and a compound represented by the general formula (I):

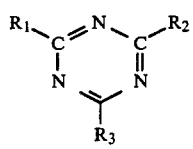

wherein $R_1$, $R_2$ and $R_3$ independently represent a hydroxy group, a hydroxylamino group, an amino group, an alkylamino group, a substituted alkylamino group, an arylamino group, an alkoxy group, a phenoxy group, an alkyl group, an aryl group or a halogen atom such that when one of $R_1$, $R_2$ and $R_3$ represents a halogen atom the other two of $R_1$, $R_2$ and $R_3$ do not represent a halogen atom, said compound represented by the general formula (I) being contained in said silver halide emulsion layer in an amount sufficient to reduce latent image fading.

2. A silver halide photographic light-sensitive material as claimed in claim 1, wherein the alkylamino group, the substituted alkylamino group, the alkoxy group and the alkyl group each have 1 to 30 carbon atoms, and the arylamino group and the aryl group each have 6 to 30 carbon atoms.

3. A silver halide photographic light-sensitive material as claimed in claim 2, wherein the alkylamino group, the substituted alkylamino group, the alkoxy group and the alkyl group each have 1 to 20 carbon atoms, and the arylamino group and the aryl group each have 6 to 20 carbon atoms.

4. A silver halide photographic light-sensitive material as claimed in claim 3, wherein the alkylamino group, the substituted alkylamino group, the alkoxy group and the alkyl group each have 1 to 10 carbon atoms, and the arylamino group and the aryl group each have 6 to 10 carbon atoms.

5. A silver halide photographic light-sensitive material as claimed in claim 1, wherein the sum of carbon atoms present in the substituents $R_1$, $R_2$ and $R_3$ is 4 to 30.

6. A silver halide photographic light-sensitive material as claimed in claim 5, whereinthe sum of carbon atoms in the substituents $R_1$, $R_2$ and $R_3$ is 8 to 20.

7. A silver halide photographic light-sensitive material as claimed in claim 1, wherein the substituent for the substituted alkylamino group is selected from the class consisting of a hydroxy group, and alkoxy group, a halogen atom, an aryl group, a carboxy group, a sulfo group and a nitro group.

8. A silver halide photographic light-sensitive material as claimed in claim 1, wherein the compound represented by the general formula (I) is present in an amount in the range of 0.00001 to 0.10 mol per mol of silver.

9. A silver halide photographic light-sensitive material as claimed in claim 8, wherein the compound of general formula (I) is present in an amount in the range of 0.0005 to 0.01 mol per mol of silver.

10. A silver halide photographic light-sensitive material as claimed in claim 9, wherein the compound represented by the general formula (I) is present in the silver halide emulsion layer.

11. A silver halide photographic light-sensitive material as claimed in claim 9, wherein the compound represented by the general formula (I) is present in a layer adjacent to the silver halide layer.

12. A silver halide photographic light-sensitive material as claimed in claim 1, wherein the hardener is present in an amount in the range of 0.01 to 20 wt% based on the weight of dry gelatin present in the silver halide emulsion layer.

13. A silver halide photographic light-sensitive material as claimed in claim 1, wherein the hardener is present in an amount in the range of 0.1 to 10 wt% based on the weight of dry gelatin.

14. A silver halide photographic light-sensitive material of claim 1 comprising a support base having thereon:

a silver halide emulsion layer containing a hardener having an active vinyl group represented by the structural formula (II):

$$(CH_2{=}CH{-}SO_2{-}CH_2)_2{-}A \qquad \text{(II)}$$

wherein A represents a divalent group which is optionally present; and a compound represented by the general formula (I):

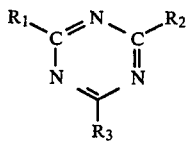

(I)

wherein $R_1$, $R_2$ and $R_3$ independently represent a hydroxy group, a hydroxylamino group, an amino group, an alkylamino group, a substituted alkylamino group, an arylamino group, an alkoxy group, a phenoxy group, an alkyl group, an aryl group or a halogen atom such that when one of $R_1$, $R_2$ and $R_3$ represents a halogen atom the other two of $R_1$, $R_2$ and $R_3$ do not represent a halogen atom and wherein one of $R_1$, $R_2$ and $R_3$ is a hydroxylamino group.

* * * * *

UNITED STATES PATENT AND TRADEMARK OFFICE

CERTIFICATE OF CORRECTION

PATENT NO. : 4,680,257

DATED : July 14, 1987

INVENTOR(S) : Hideaki Sato and Morio Yagihara

It is certified that error appears in the above-identified patent and that said Letters Patent is hereby corrected as shown below:

Claim 1, last line, delete "reduce latent image fading" and insert therefor --prevent latensification--.

Signed and Sealed this

Sixteenth Day of February, 1988

*Attest:*

DONALD J. QUIGG

*Attesting Officer*

*Commissioner of Patents and Trademarks*